US009720366B2

(12) United States Patent
Tonges

(10) Patent No.: US 9,720,366 B2
(45) Date of Patent: Aug. 1, 2017

(54) DRIVE COUPLER FOR A ROTATABLE COMPONENT OF AN ELECTROPHOTOGRAPHIC IMAGE FORMING DEVICE

(71) Applicant: LEXMARK INTERNATIONAL, INC., Lexington, KY (US)

(72) Inventor: Jeffrey Lawrence Tonges, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/170,182

(22) Filed: Jun. 1, 2016

(65) Prior Publication Data

US 2017/0075286 A1 Mar. 16, 2017

Related U.S. Application Data

(60) Provisional application No. 62/218,675, filed on Sep. 15, 2015.

(51) Int. Cl.
*G03G 15/00* (2006.01)

(52) U.S. Cl.
CPC ..... *G03G 15/757* (2013.01)

(58) Field of Classification Search
CPC ..... G03G 15/757
USPC ..... 399/159, 167
See application file for complete search history.

(56) References Cited

U.S. PATENT DOCUMENTS 9,316,988 B2 * 4/2016 Hayashi ..... G03G 15/757

* cited by examiner

*Primary Examiner* — William J Royer
(74) *Attorney, Agent, or Firm* — Justin M. Tromp

(57) ABSTRACT

A drive element for a rotatable component of an electrophotographic image forming device according to one example embodiment includes a body having a center hole for receiving a drive shaft therein. The center hole defines a rotational axis of the body. A drive coupler is positioned on the body and centered around the rotational axis. A drive slot on the body extends radially relative to the rotational axis and is sized to receive a cross pin. The drive slot includes one or more snap features formed on the body that are positioned to retain the cross pin axially in the drive slot and that permit the cross pin to snap axially into and out of the drive slot.

17 Claims, 6 Drawing Sheets

DRIVE COUPLER FOR A ROTATABLE COMPONENT OF AN ELECTROPHOTOGRAPHIC IMAGE FORMING DEVICE

CROSS REFERENCES TO RELATED APPLICATIONS

This application claims priority to U.S. Provisional Patent Application Ser. No. 62/218,675, filed Sep. 15, 2015, entitled "Drive Coupler for a Rotatable Component of an Electrophotographic Image Forming Device," the content of which is hereby incorporated by reference in its entirety.

BACKGROUND

1. Field of the Disclosure

The present disclosure relates generally to image forming devices and more particularly to a drive coupler for a rotatable component of an electrophotographic image forming device.

2. Description of the Related Art

FIG. 1 shows a prior art photoconductive drum ("PC drum") 20. PC drum 20 includes a hollow, cylindrical metal sleeve 22 that is open at each end and has a photoconductive outer surface 24 as is known in the art. PC drum 20 also includes a drive shaft 26 that runs through the center of metal sleeve 22 and defines a rotational axis 28 of PC drum 20. An end cap 30 is mounted in one open axial end of metal sleeve 22 by a friction fit. End cap 30 includes a drive coupler in the form of a spur gear 32 on an outer axial side 34 of end cap 30.

FIG. 2 shows PC drum 20 with metal sleeve 22 removed to more clearly illustrate the features of end cap 30. With reference to FIGS. 1 and 2, in order to assemble PC drum 20, drive shaft 26 is inserted into metal sleeve 22 and through a center hole 36 in end cap 30. Drive shaft 26 is rotated and translated axially relative to metal sleeve 22 and end cap 30 until a radial hole 38 in end cap 30 is aligned with a radial hole (obstructed by end cap 30 in FIGS. 1 and 2) in drive shaft 26. A cross pin 40 is then inserted in the direction indicated by arrow 31 in FIG. 2 through radial hole 38 in end cap 30 and the aligned radial hole in drive shaft 26 until cross pin 40 is aligned with a drive slot 42 on an axially outboard face 44 of end cap 30. Then drive shaft 26 and cross pin 40 are pushed relative to end cap 30 axially inward until cross pin 40 seats into drive slot 42. To secure cross pin 40 in place, a retaining ring 46 is snapped to end cap 30 so that it provides an axial load between cross pin 40 and end cap 30. A pair of retention tabs 48 on end cap 30 prevent retaining ring 46 from slipping axially off of end cap 30. A pair of rotational stops 50 limit the rotation of retaining ring 46 relative to end cap 30.

SUMMARY

A drive element for a rotatable component of an electrophotographic image forming device according to one example embodiment includes a body having a center hole for receiving a drive shaft therein. The center hole defines a rotational axis of the body. A drive coupler is positioned on the body and centered around the rotational axis. A drive slot on the body extends radially relative to the rotational axis and is sized to receive a cross pin. The drive slot includes one or more snap features formed on the body that are positioned to retain the cross pin axially in the drive slot and that permit the cross pin to snap axially into and out of the drive slot.

A photoconductive drum for an electrophotographic image forming device according to one example embodiment includes a cylindrical sleeve having a photoconductive outer surface. A rotatable drive shaft extends along a center of the sleeve. The drive shaft defines a rotational axis of the photoconductive drum. A cross pin extends radially through the drive shaft relative to the rotational axis of the photoconductive drum. The cross pin is rotatable with the drive shaft. An end cap is mounted at a first axial end of the sleeve. The end cap is rotatable with the sleeve about the rotational axis of the photoconductive drum. The end cap includes a drive coupler exposed to allow the drive coupler to mate with a corresponding drive coupler. The end cap also includes a drive slot that includes one or more snap features. The one or more snap features are formed on the end cap and retain the cross pin axially in the drive slot. Engagement of the cross pin in the drive slot of the end cap rotatably couples the end cap and the sleeve to the cross pin and the drive shaft. The one or more snap features permit the cross pin to snap axially into and out of the drive slot for assembly and disassembly of the photoconductive drum.

A photoconductive drum for an electrophotographic image forming device according to another example embodiment includes a cylindrical sleeve having a photoconductive outer surface. A rotatable drive shaft extends along a center of the sleeve. The drive shaft defines a rotational axis of the photoconductive drum. A cross pin extends radially through the drive shaft relative to the rotational axis of the photoconductive drum. The cross pin is rotatable with the drive shaft. An end cap is mounted at a first axial end of the sleeve. The end cap is rotatable with the sleeve about the rotational axis of the photoconductive drum. The end cap includes a drive coupler exposed on an outer axial side of the end cap. The end cap also includes a drive slot recessed into an axially outboard face of the end cap and spaced axially inward from the drive coupler. The drive slot includes one or more snap features. The one or more snap features are formed on the end cap and retain the cross pin axially in the drive slot. Engagement of the cross pin in the drive slot of the end cap rotatably couples the end cap and the sleeve to the cross pin and the drive shaft. The one or more snap features permit the cross pin to snap axially into and out of the drive slot for assembly and disassembly of the photoconductive drum. The end cap also includes a radial hole that extends longitudinally in a radial direction relative to the rotational axis of the photoconductive drum. The radial hole is positioned axially between the drive coupler and the drive slot. The radial hole is open axially to the drive slot. The radial hole permits removal of the cross pin from the end cap when the cross pin snaps axially out of the drive slot during disassembly of the photoconductive drum and permits the cross pin to align with and axially snap into the drive slot during assembly of the photoconductive drum.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
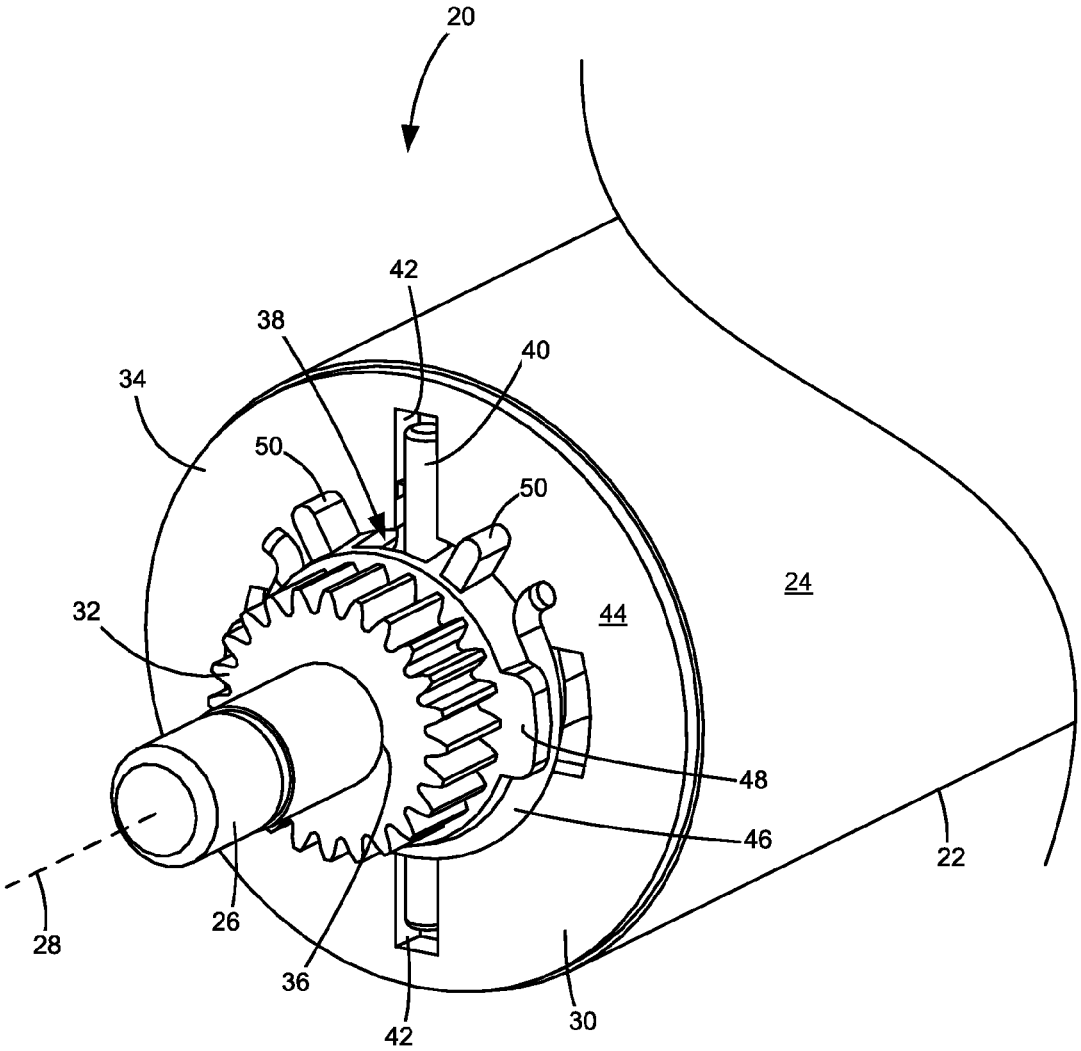
Figure 1 (Prior Art)
FIG. 1 is a perspective view of a prior art photoconductive drum showing a drive coupler thereof.
Figure 2:
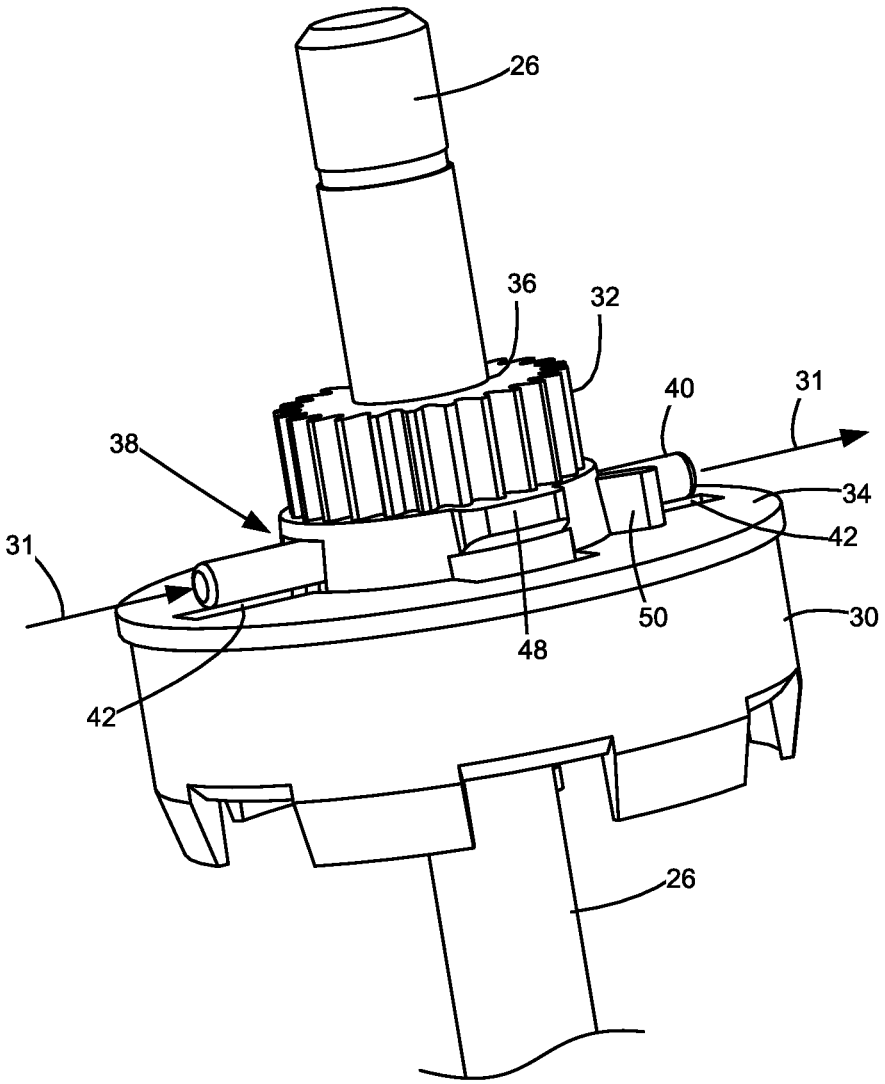
Figure 2 (Prior Art)
FIG. 2 is a perspective view of the prior art photoconductive drum shown in FIG. 1 with a metal sleeve of the photoconductive drum removed showing the insertion of a cross pin into an end cap and a drive shaft of the photoconductive drum.
Figure 3:
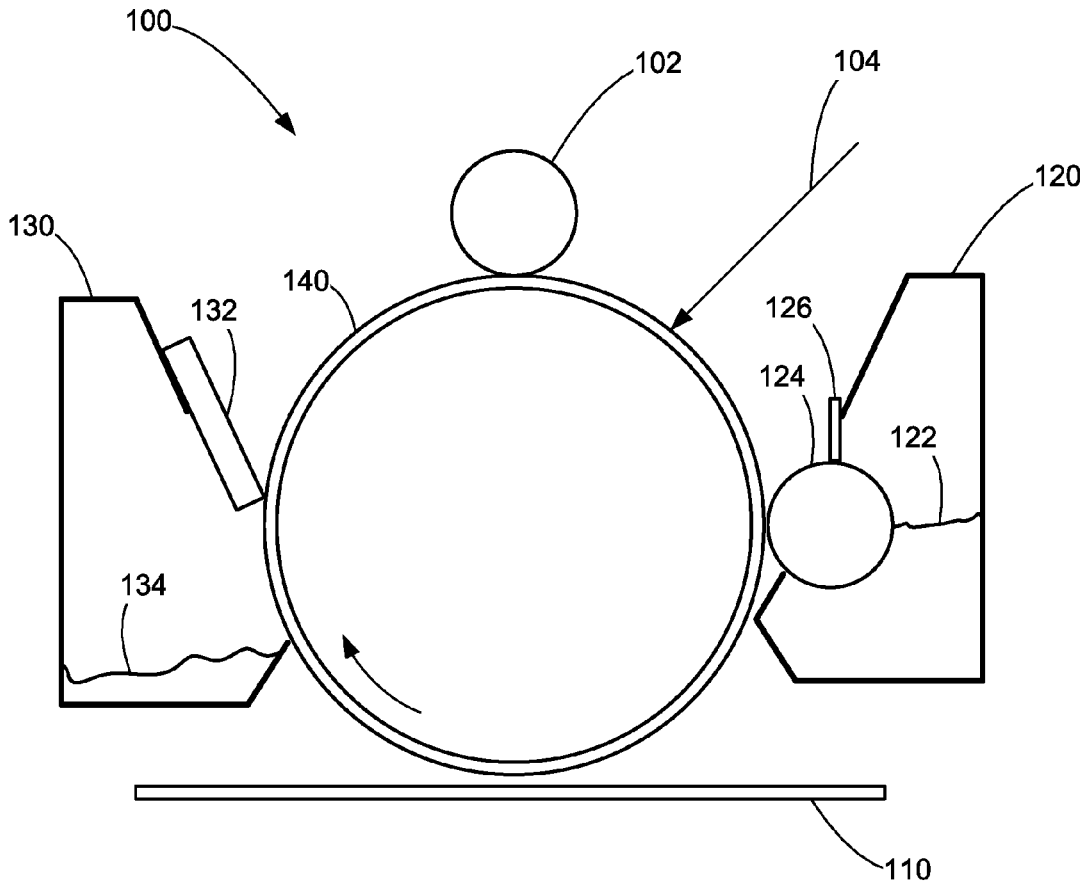
FIG. 3 is a schematic view of an electrophotographic image forming device according to one example embodiment.

FIG. 3 illustrates a schematic representation of an example electrophotographic image forming device 100. Image forming device 100 includes a photoconductive drum ("PC drum") 140, a charge roll 102, a developer unit 120 and a cleaner unit 130. The electrophotographic printing process is well known in the art and, therefore, is described briefly herein. During a print operation, charge roll 102 charges the surface of PC drum 140. The charged surface of PC drum 140 is then selectively exposed to a laser light source 104 to form an electrostatic latent image on PC drum 140 corresponding to the image being printed. Charged toner from developer unit 120 is picked up by the latent image on PC drum 140 creating a toned image.

Developer unit 120 includes a toner reservoir 122 having toner particles stored therein and a developer roll 124 that supplies toner from toner reservoir 122 to PC drum 140. Developer roll 124 is electrically charged and electrostatically attracts the toner particles from toner reservoir 122. A doctor blade 126 disposed along developer roll 124 provides a substantially uniform layer of toner on developer roll 124 for subsequent transfer to PC drum 140. As developer roll 124 and PC drum 140 rotate, toner particles are electrostatically transferred from developer roll 124 to the latent image on PC drum 140 forming a toned image on the surface of PC drum 140. In one embodiment, developer roll 124 and PC drum 140 rotate in opposite rotational directions such that their adjacent surfaces move in the same direction to facilitate the transfer of toner from developer roll 124 to PC drum 140. A toner adder roll (not shown) may also be provided to supply toner from toner reservoir 122 to developer roll 124. Further, one or more agitators (not shown) may be provided in toner reservoir 122 to distribute the toner therein and to break up any clumped toner.

The toned image is then transferred from PC drum 140 to print media 110 (e.g., paper) either directly by PC drum 140 or indirectly by an intermediate transfer member. A fusing unit (not shown) fuses the toner to print media 110. A cleaning blade 132 (or cleaning roll) of cleaner unit 130 removes any residual toner adhering to PC drum 140 after the toner is transferred to print media 110. Waste toner from cleaning blade 132 is held in a waste toner reservoir 134 in cleaner unit 130. The cleaned surface of PC drum 140 is then ready to be charged again and exposed to laser light source 104 to continue the printing cycle.

The components of image forming device 100 are replaceable as desired. For example, in one embodiment, developer unit 120 is housed in a replaceable unit with PC drum 140, cleaner unit 130 and the main toner supply of image forming device 100. In another embodiment, developer unit 120 is provided with PC drum 140 and cleaner unit 130 in a first replaceable unit while the main toner supply of image forming device 100 is housed in a second replaceable unit. In another embodiment, developer unit 120 is provided with the main toner supply of image forming device 100 in a first replaceable unit and PC drum 140 and cleaner unit 130 are provided in a second replaceable unit. In another embodiment, developer unit 120 is provided in a first replaceable unit, the main toner supply of image forming device 100 is provided in a second replaceable unit and PC drum 140 and cleaner unit 130 are provided in a third replaceable unit. Further, any other combination of replaceable units may be used as desired.

Figure 4:
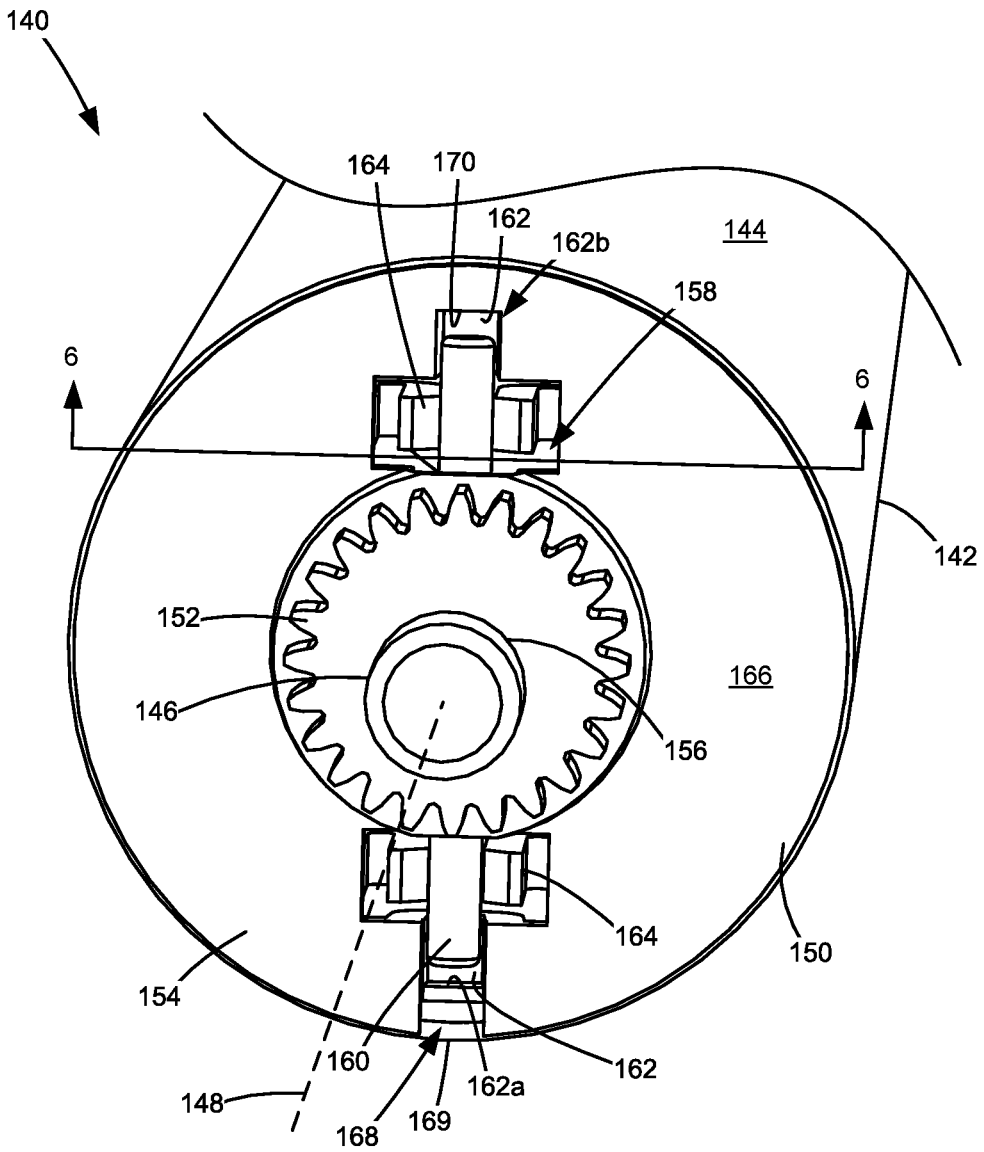
FIG. 4 is a perspective view of a photoconductive drum showing a drive coupler thereof according to one example embodiment.

FIG. 4 shows PC drum 140 in more detail according to one example embodiment. PC drum 140 includes a hollow, cylindrical metal sleeve 142 that is open at each end and has a photoconductive outer surface 144 as is known in the art. PC drum 140 also includes a drive shaft 146 that extends along the center of metal sleeve 142 and defines a rotational axis 148 of PC drum 140. An end cap 150 is mounted in one open axial end of metal sleeve 142, such as by a friction fit. End cap 150 includes a drive coupler 152, such as a toothed gear (e.g., a spur or helical gear) or other form of drive coupler (e.g., an Oldham coupler), exposed on an outer axial side 154 of end cap 150. Drive coupler 152 is centered around rotational axis 148. Drive coupler 152 may be used to receive rotational motion to drive PC drum 140 or to transfer rotational motion from PC drum 140 to another rotatable component of image forming device 100.

Figure 5:
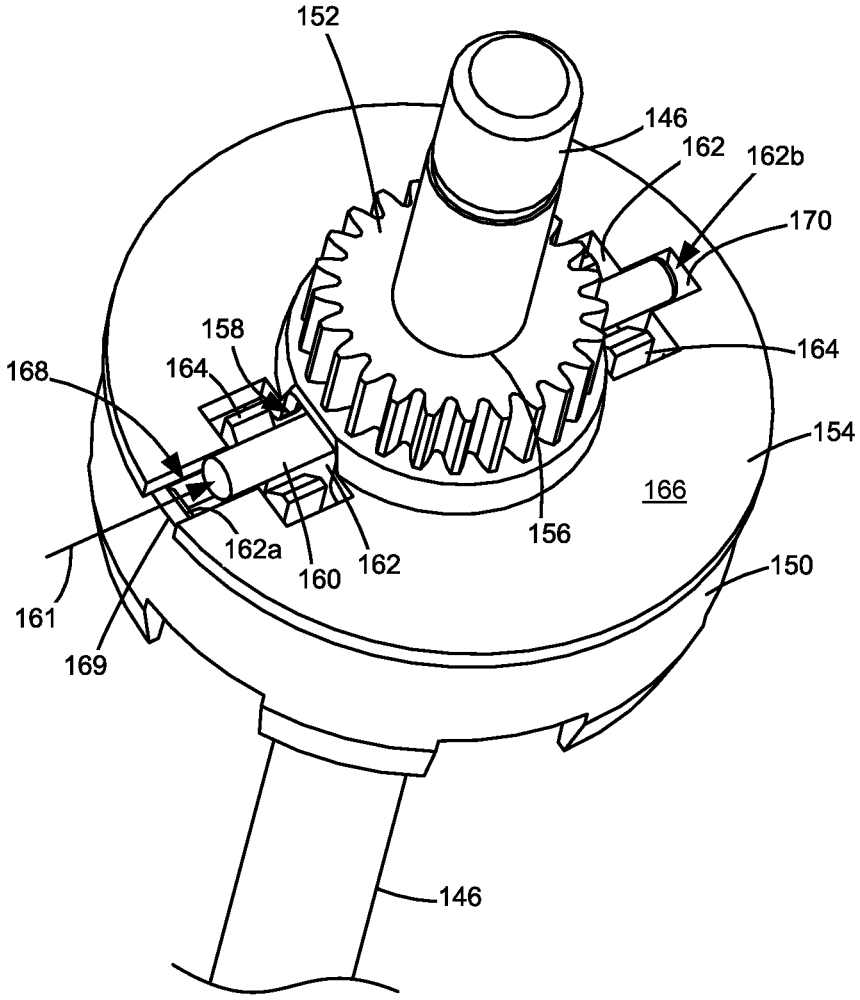
FIG. 5 is a perspective view of the photoconductive drum shown in FIG. 4 with a metal sleeve of the photoconductive drum removed showing the insertion of a cross pin into an end cap and a drive shaft of the photoconductive drum according to one example embodiment.

FIG. 5 shows PC drum 140 with metal sleeve 142 removed to more clearly illustrate the features of end cap 150. With reference to FIGS. 4 and 5, in order to assemble PC drum 140, drive shaft 146 is inserted into metal sleeve 142 and through a center hole 156 in end cap 150. In this manner, center hole 156 of end cap 150 is centered around rotational axis 148 of PC drum 140. Drive shaft 146 is rotated and translated axially relative to metal sleeve 142 and end cap 150 until a radial hole 158 in end cap 150 is aligned with a radial hole (obstructed by end cap 150 in FIGS. 4 and 5) in drive shaft 146. Radial hole 158 extends longitudinally in a radial direction relative to rotational axis 148 of PC drum 140 and center hole 156 of end cap 150. In the embodiment illustrated, radial hole 158 is positioned on outer axial side 154 of end cap 150 and is spaced axially inward from drive coupler 152 on end cap 150. In this embodiment, radial hole 158 is positioned axially between drive coupler 152 and a drive slot 162. Radial hole 158 is open axially to drive slot 162.

Once radial hole 158 in end cap 150 is aligned with the radial hole in drive shaft 146, a cross pin 160 is inserted in the direction indicated by arrow 161 in FIG. 5 through radial hole 158 in end cap 150 and the aligned radial hole in drive shaft 146 until cross pin 160 is aligned with drive slot 162 and one or more sets of snap features 164 on an axially outboard face 166 of end cap 150. Snap features 164 are formed integrally with end cap 150. Drive slot 162 of end cap 150 extends radially relative to rotational axis 148 and is angularly aligned with radial hole 158 in end cap 150. In the embodiment illustrated, drive slot 162 is recessed into axially outboard face 166 of end cap 150. In one embodiment, cross pin 160 is inserted at one radial edge of end cap 150 and pushed to a positive stop near an opposite radial edge of end cap 150. For example, in the embodiment illustrated, cross pin 160 passes through a recessed channel 168 in axially outboard face 166 of end cap 150 that runs from a first end 162*a* of drive slot 162 to an outer radial edge 169 of end cap 150. Cross pin 160 then passes through radial hole 158 and continues until cross pin 160 contacts a stop 170 formed at second end 162*b* of drive slot 162. Stop 170 prevents over-insertion of cross pin 160 into radial hole 158. Stop 170 also provides installation feedback to the installer to prevent under-insertion of cross pin 160 into radial hole 158. In this manner, channel 168 and stop 170 help ensure that cross pin 160 is reliably aligned with drive slot 162.

Once cross pin 160 is inserted through radial hole 158 in end cap 150 and the aligned radial hole in drive shaft 146 and cross pin 160 is aligned with drive slot 162, drive shaft 146 and cross pin 160 are pushed relative to end cap 150 axially inward until cross pin 160 passes through snap features 164 and into drive slot 162. Cross pin 160 translates axially inward relative to end cap 150 through snap features 164 and into drive slot 162. Snap features 164 retain cross pin 160 axially within drive slot 162. In the example embodiment illustrated, end cap 150 includes two sets of snap features 164, one near each radial end of drive slot 162. However, more or fewer sets of snap features 164 may be used as desired.

Figure 6:
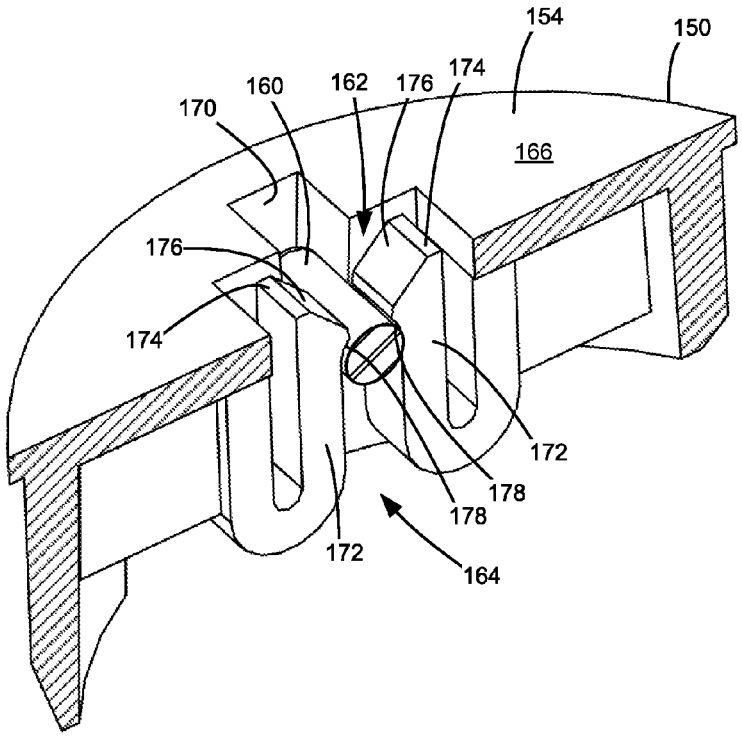
FIG. 6 is a cross-sectional view of the end cap taken along line 6-6 in FIG. 4 showing a pair of deflectable arms that retain a cross pin therebetween according to one example embodiment.

With reference to FIG. 6, in the embodiment illustrated, each set of snap features 164 includes a pair of deflectable arms 172 that are resiliently biased toward each other. For example, in the embodiment illustrated, arms 172 are composed of a resilient plastic material. Each arm 172 extends axially outward in a cantilevered manner from within drive slot 162. In the free state of arms 172 (shown in FIG. 6), free ends 174 of the arms 172 of each set of snap features 164 are separated from each other at their closest point by a distance that is less than the diameter of cross pin 160. Free end 174 of each arm 172 includes a tapered lead-in 176 that is angled axially inward relative to end cap 150 and toward its opposite arm 172. As cross pin 160 advances toward drive slot 162 when drive shaft 146 and cross pin 160 are pushed axially inward relative to end cap 150, cross pin 160 contacts the tapered lead-in 176 of one or both of the arms 172 of each set of snap features 164 causing one or both of the arms 172 of each set of snap features 164 to deflect away from its opposite arm 172. As cross pin 160 continues to advance into drive slot 162, cross pin 160 passes a retaining lip 178 on an inner axial side of each arm 172 to a point where arms 172 return to their free state. When arms 172 are in their free state and cross pin 160 is seated in drive slot 162, retaining lips 178 of arms 172 capture cross pin 160 axially in order to prevent cross pin 160 from axially disengaging from drive slot 162.

Figure 7:
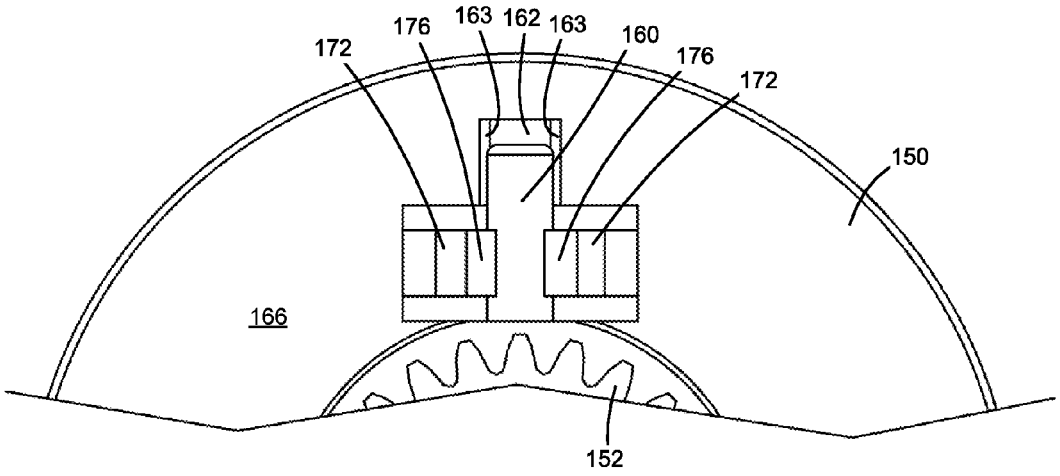
FIG. 7 is an end view of a portion of the end cap shown in FIGS. 4-6 according to one example embodiment.

With reference to FIG. 7, in one embodiment, once cross pin 160 is seated in drive slot 162, sufficient clearance is present between arms 172 and cross pin 160 such that arms 172 are not loaded rotationally when PC drum 140 is rotated in either direction. Instead, when PC drum 140 is rotated, contact between inner surfaces 163 of drive slot 162 and cross pin 160 transfers rotational motion between end cap 150 and cross pin 160. Although the example embodiment illustrated includes arms 172 that serve as snap features 164, any suitable resiliently deflectable snap features 164 may be used as desired.

With reference back to FIGS. 4 and 5, drive shaft 146 can be removed by simply pushing drive shaft 146 and cross pin 160 axially outward relative to end cap 150 until cross pin 160 passes through snap features 164. Then cross pin 160 can be pulled radially out of end cap 150 and drive shaft 146. Drive shaft 146 can then be pulled out of end cap 150. The entire removal of drive shaft 146 from end cap 150 can typically be accomplished by hand without use of any tools permitting relative easy repair or replacement of the entire PC drum 140 or of end cap 150.

By eliminating retaining ring 46 and retention tabs 48 of the prior art end cap 30 discussed above, the width of end cap 150 of the present disclosure in the axial dimension of PC drum 140 is reduced in comparison with the prior art PC drum 20. This allows a replaceable unit that includes PC drum 140 to have a smaller overall length in the axial dimension of PC drum 140 without reducing the axial length of the photoconductive outer surface 144 of PC drum 140, which would reduce the page width that image forming device 100 is able to print. Eliminating retaining ring 46 also simplifies the assembly and disassembly of PC drum 140 and reduces the number of components used.

While the example embodiment illustrated includes an end cap 150 having a drive coupler 152 for use with a PC drum 140, other rotatable components or rolls of an electrophotographic image forming device may use a similar configuration, such as, for example, a drive coupler of a toner bottle, a drive coupler of a developer roll (either in a single component development image forming device or a dual component development image forming device), etc. Further, although the example embodiment illustrated includes cross pin 160 entering snap features 164 and drive slot 162 from outer axial side 154 of end cap 150, this configuration may be reversed as desired such that cross pin 160 enters snap features 164 and drive slot 162 from an inner axial side of end cap 150.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A drive element for a rotatable component of an electrophotographic image forming device, comprising:

a body having a center hole for receiving a drive shaft therein, the center hole defining a rotational axis of the body;

a drive coupler positioned on the body and centered around the rotational axis; and a drive slot on the body extending radially relative to the rotational axis and sized to receive a cross pin, the drive slot includes one or more snap features formed on the body that are positioned to retain the cross pin axially in the drive slot and that permit the cross pin to snap axially into and out of the drive slot.

2. The drive element of claim 1, wherein the drive coupler is positioned on an outer axial side of the body.

3. The drive element of claim 2, wherein the drive slot is recessed into an axially outboard face of the body and spaced axially inward from the drive coupler.

4. The drive element of claim 3, further comprising a radial hole that extends longitudinally in a radial direction relative to the rotational axis of the body, the radial hole is positioned axially between the drive coupler and the drive slot, the radial hole is open axially to the drive slot, the radial hole permits removal of the cross pin from the body when the cross pin snaps axially out of the drive slot and permits the cross pin to align with and axially snap into the drive slot.

5. The drive element of claim 1, wherein the one or more snap features includes two sets of snap features, each of the two sets of snap features is positioned near a respective radial end of the drive slot.

6. The drive element of claim 1, wherein the one or more snap features includes a pair of deflectable arms between which the cross pin passes to snap axially into or out of the drive slot.

7. A photoconductive drum for an electrophotographic image forming device, comprising:

a cylindrical sleeve having a photoconductive outer surface;

a rotatable drive shaft extending along a center of the sleeve, the drive shaft defines a rotational axis of the photoconductive drum;

a cross pin extending radially through the drive shaft relative to the rotational axis of the photoconductive drum, the cross pin is rotatable with the drive shaft; and an end cap mounted at a first axial end of the sleeve, the end cap is rotatable with the sleeve about the rotational axis of the photoconductive drum, the end cap includes:

a drive coupler exposed to allow the drive coupler to mate with a corresponding drive coupler; and a drive slot that includes one or more snap features, the one or more snap features are formed on the end cap and retain the cross pin axially in the drive slot, wherein engagement of the cross pin in the drive slot of the end cap rotatably couples the end cap and the sleeve to the cross pin and the drive shaft, wherein the one or more snap features permit the cross pin to snap axially into and out of the drive slot for assembly and disassembly of the photoconductive drum.

8. The photoconductive drum of claim 7, wherein the drive coupler is positioned on an outer axial side of the end cap.

9. The photoconductive drum of claim 8, wherein the drive slot is recessed into an axially outboard face of the end cap and spaced axially inward from the drive coupler.

10. The photoconductive drum of claim 9, further comprising a radial hole in the end cap that extends longitudinally in a radial direction relative to the rotational axis of the photoconductive drum, the radial hole is positioned axially between the drive coupler and the drive slot, the radial hole is open axially to the drive slot, the radial hole permits removal of the cross pin from the end cap when the cross pin snaps axially out of the drive slot during disassembly of the photoconductive drum and permits the cross pin to align with and axially snap into the drive slot during assembly of the photoconductive drum.

11. The photoconductive drum of claim 7, wherein the one or more snap features includes two sets of snap features, each of the two sets of snap features is positioned near a respective radial end of the drive slot.

12. The photoconductive drum of claim 7, wherein the one or more snap features includes a pair of deflectable arms between which the cross pin passes to snap axially into or out of the drive slot.

13. The photoconductive drum of claim 7, wherein sufficient clearance is present between the one or more snap features and the cross pin such that the one or more snap features are not loaded rotationally when the photoconductive drum rotates.

14. A photoconductive drum for an electrophotographic image forming device, comprising:

a cylindrical sleeve having a photoconductive outer surface;

a rotatable drive shaft extending along a center of the sleeve, the drive shaft defines a rotational axis of the photoconductive drum;

a cross pin extending radially through the drive shaft relative to the rotational axis of the photoconductive drum, the cross pin is rotatable with the drive shaft; and an end cap mounted at a first axial end of the sleeve, the end cap is rotatable with the sleeve about the rotational axis of the photoconductive drum, the end cap includes:

a drive coupler exposed on an outer axial side of the end cap;

a drive slot recessed into an axially outboard face of the end cap and spaced axially inward from the drive coupler, the drive slot includes one or more snap features, the one or more snap features are formed on the end cap and retain the cross pin axially in the drive slot, engagement of the cross pin in the drive slot of the end cap rotatably couples the end cap and the sleeve to the cross pin and the drive shaft, the one or more snap features permit the cross pin to snap axially into and out of the drive slot for assembly and disassembly of the photoconductive drum; and a radial hole that extends longitudinally in a radial direction relative to the rotational axis of the photoconductive drum, the radial hole is positioned axially between the drive coupler and the drive slot, the radial hole is open axially to the drive slot, the radial hole permits removal of the cross pin from the end cap when the cross pin snaps axially out of the drive slot during disassembly of the photoconductive drum and permits the cross pin to align with and axially snap into the drive slot during assembly of the photoconductive drum.

15. The photoconductive drum of claim 14, wherein the one or more snap features includes two sets of snap features, each of the two sets of snap features is positioned near a respective radial end of the drive slot.

16. The photoconductive drum of claim 14, wherein the one or more snap features includes a pair of deflectable arms between which the cross pin passes to snap axially into or out of the drive slot.

17. The photoconductive drum of claim 14, wherein sufficient clearance is present between the one or more snap features and the cross pin such that the one or more snap features are not loaded rotationally when the photoconductive drum rotates.

* * * * *